US009048532B2

(12) United States Patent
Yu et al.

(10) Patent No.: US 9,048,532 B2
(45) Date of Patent: Jun. 2, 2015

(54) MULTI-BAND ANTENNA

(71) Applicants: Chung-Ta Yu, Taipei (TW); Shih-Ping Liu, Taipei (TW)

(72) Inventors: Chung-Ta Yu, Taipei (TW); Shih-Ping Liu, Taipei (TW)

(73) Assignee: COMPAL ELECTRONICS, INC., Taipei (TW)

( * ) Notice: Subject to any disclaimer, the term of this patent is extended or adjusted under 35 U.S.C. 154(b) by 201 days.

(21) Appl. No.: 13/721,028

(22) Filed: Dec. 20, 2012

(65) Prior Publication Data

US 2014/0132453 A1 May 15, 2014

(30) Foreign Application Priority Data

Nov. 14, 2012 (TW) ..... 101142420 A

(51) Int. Cl.
*H01Q 1/24* (2006.01)
*H01Q 1/22* (2006.01)
*H01Q 9/04* (2006.01)

(52) U.S. Cl.
CPC ..... *H01Q 1/2266* (2013.01); *H01Q 9/0421* (2013.01); *H01Q 5/371* (2015.01)

(58) Field of Classification Search
CPC .... H01Q 1/2266; H01Q 5/371; H01Q 9/0421
USPC ..... 343/702, 700 MS
See application file for complete search history.

(56) References Cited

U.S. PATENT DOCUMENTS 7,439,916 B2 * 10/2008 Wang et al. ..... 343/700 MS
2008/0129612 A1 6/2008 Wang et al.

FOREIGN PATENT DOCUMENTS

TW I232369 5/2005
TW I355775 1/2012

OTHER PUBLICATIONS

"Office Action of Taiwan Counterpart Application", issued on Jan. 23, 2015, pp. 1-7.
K.L. Wong, Y.C. Liu and L.C. Chou, "Bandwidth enhancement of WWAN/LTE tablet computer antenna using embedded parallel resonant circuit," Microwave Opt. Technol. Lett., vol. 54, pp. 426-431, Feb. 2012.

* cited by examiner

*Primary Examiner* — Hoang V Nguyen
(74) *Attorney, Agent, or Firm* — Jianq Chyun IP Office

(57) ABSTRACT

A multi-band antenna suitable for an electronic device is provided. The electronic device has a metal shell. The multi-band antenna includes a ground portion, a radiating portion and a feeding portion. The ground portion has a ground plane. The radiating portion has at least one radiating section and a short-circuit section. An extending direction of the radiating section is parallel to the ground plane. The short-circuit section is electrically connected between the radiating section and the ground plane. The ground portion is adapted to obstruct a path between the metal shell and the radiating section. The feeding portion is electrically connected to the radiating section.

13 Claims, 8 Drawing Sheets

MULTI-BAND ANTENNA

CROSS-REFERENCE TO RELATED APPLICATION

This application claims the priority benefit of Taiwan application serial no. 101142420, filed on Nov. 14, 2012. The entirety of the above-mentioned patent application is hereby incorporated by reference herein and made a part of this specification.

BACKGROUND OF THE INVENTION

1. Field of the Invention

The present invention is related to an antenna and particularly to a multi-band antenna.

2. Description of Related Art

With recent advancements of technologies, communication methods of the public are gradually changed to wireless communications, devices such as a smart phone, a tablet PC capable of surfing the Internet and a notebook computer all fall within the scope of wireless communications, in which an antenna is required for transmitting signal.

Planar Inverted-F Antenna (PIFA) is one of the most commonly seen antenna, such antenna has a fundamental mode that operates in a quarter of wave length thereby reducing a length of the antenna, which meets the compact and requirement of modern electronic products. However, as design trend of electronic devices being lighter and thinner each day, if the electronic device is provided with metal shell, it is difficult to have the antenna disposed far from the metal shell, such that signal of the antenna may be interfered by the metal shell. Take notebook computer for instance, if an antenna is disposed on the display screen while the host is made of metal shell, once a user have the display screen closed on the host, a signal interference may occur to the antenna for being to close to the metal shell of the host.

SUMMARY OF THE INVENTION

The present invention provides a multi-band antenna to avoid interference by metal shell.

In the invention, a multi-band antenna adapted for an electronic device is provided. The electronic device has a metal shell. The multi-band antenna includes a ground portion, a radiating portion and a feeding portion. The ground portion has a ground plane. The radiating portion has at least one radiating section and a short-circuit section. An extending direction of the at least one radiating section is parallel to the ground plane. The short-circuit section is electrically connected between the radiating section and the ground plane. The ground portion is adapted to obstruct a path between the metal shell and the radiating section. The feeding portion is electrically connected to the at least one radiating section.

According to an embodiment of the invention, a shortest distance between the short-circuit section and the feeding portion is equal to a width of the ground portion.

According to an embodiment of the invention, an extended direction of the conductive line is parallel to the surface of the substrate.

According to an embodiment of the invention, the electronic device includes a first body and a second body, the first body is pivoted to the second body, the metal shell is disposed on the first body, the multi-band antenna is disposed on the second body, the ground portion obstructs the path between the metal shell and the radiating section when the second body is closed on the first body.

According to an embodiment of the invention, the multi-band antenna is secured on a side of the metal shell, and the ground portion obstructs the path between the metal shell and the radiating section.

According to an embodiment of the invention, an orthogonal projection of the radiating section on the metal shell is located within an orthographic projection of ground portion on the metal shell when the ground portion obstructs the path between the metal shell and the radiating section.

According to an embodiment of the invention, a thickness of the metal layer is larger than 3.5 millimeter.

According to an embodiment of the invention, an amount of the at least one radiating section is more than one and the radiating sections includes a first radiating section, a second radiating section and a third radiating section.

According to the present embodiment, a length of the first radiating section is 0.25 times to a wavelength of a first resonance frequency band, a length of the second radiating section is 0.25 times to a wavelength of a second resonance frequency band and a length of the third radiating section is 0.25 times to a wavelength of a third resonance frequency band.

According to an embodiment of the invention, the second resonance frequency band is similar to the third resonance frequency band, an operating frequency band is composed by the second resonance frequency band and the third resonance frequency band, a frequency range of the operating frequency band is greater than a frequency range of the second resonance frequency band and a frequency range of the third resonance frequency band.

According to an embodiment of the invention, a first slot is provided between the first radiating section and the second radiating section, an opening direction of the first slot is parallel to an extending direction of the first radiating section.

According to an embodiment of the invention, the first slot has a closed end and an opening end opposite to one another, a width of the first slot is gradually increased from the closed end to the opening end.

According to an embodiment of the invention, a second slot is provided between the second radiating section and the third radiating section, an opening direction of the second slot is parallel to an extending direction of the third radiating section.

According to an embodiment of the invention, the electronic device has a radio frequency circuit, the feeding portion is used for feeding a radio frequency signal of the radio frequency circuit.

Based on above, in the multi-band antenna according the invention, the extending directions of the radiating sections are parallel to the ground plane, and the ground portion obstructs a path between the metal shell of the electronic device and the radiating sections of the multi-band antenna. Accordingly, even though the radiating sections of the multi-band antenna are adjacent to the metal shell, interference to the radiating sections caused by the metal shell may be avoided by the ground portion obstructing the path between the radiating portion and the metal shell, so that the multi-band antenna may have a favorable capability for transceiving signal.

To make the above features and advantages of the invention more comprehensible, several embodiments accompanied with drawings are described in detail as follows.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
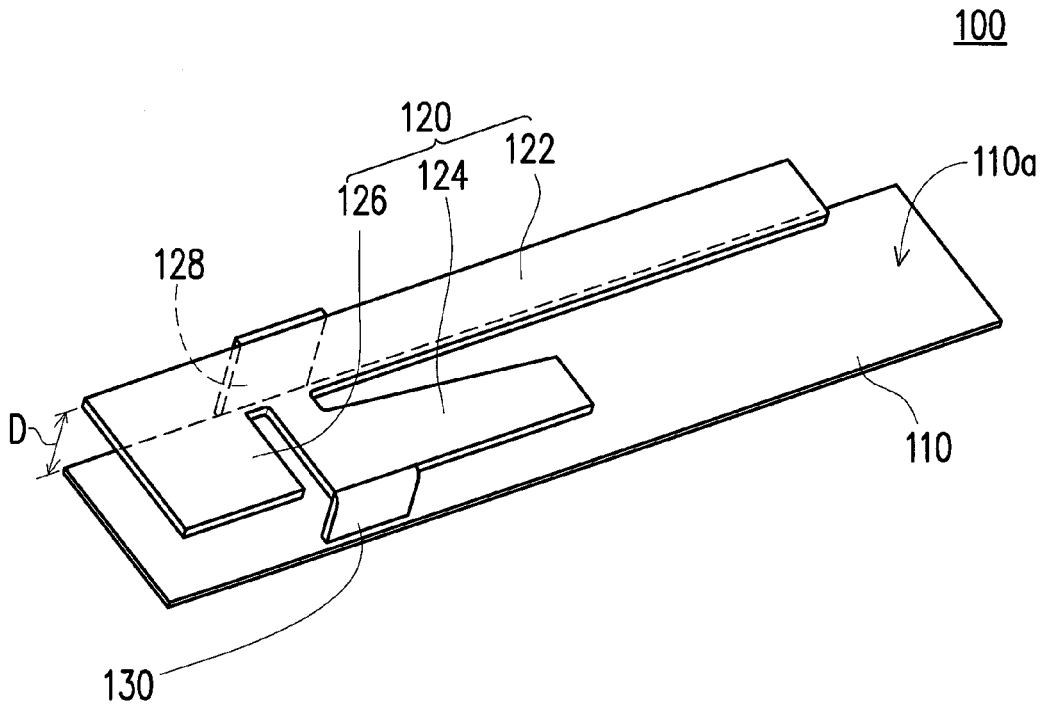
FIG. 1 is a three-dimensional view of a multi-band antenna according to an embodiment of the invention.

Reference will now be made in detail to the present preferred embodiments of the invention, examples of which are illustrated in the accompanying drawings. Wherever possible, the same reference numbers are used in the drawings and the description to refer to the same or like parts.

FIG. 1 is a three-dimensional view of a multi-band antenna according to an embodiment of the invention. Referring to FIG. 1, a multi-band antenna 100 of the present embodiment is, for example, a planar inverted-F antenna (PIFA) including a ground portion 110, a radiating portion 120 and a feeding portion 130. The ground portion 110 has a ground plane 110*a*. The radiating portion 120 has at least one radiating section (illustrated as a first radiating section 122, a second radiating section 124 and a third radiating section 126) and a short-circuit section 128. Extending directions of the first radiating section 122, the second radiating section 124 and the third radiating section 126 are all parallel to the ground plane 110*a*. The short-circuit section 128 is electrically connected between the first radiating section 122, the second radiating section 124 and the third radiating section 126 and the ground place 110*a*, so that the first radiating section 122, the second radiating section 124 and the third radiating section 126 grounded to the ground plane 110*a* accordingly. The feeding portion 130 is electrically connected to the second radiating section 124 for feeding signal to the first radiating section 122, the second radiating section 124 and the third radiating section 126. A shortest distance between the short-circuit section 128 and the feeding portion 130 is, for example, equal to a width of the ground portion 110.

Figure 2:
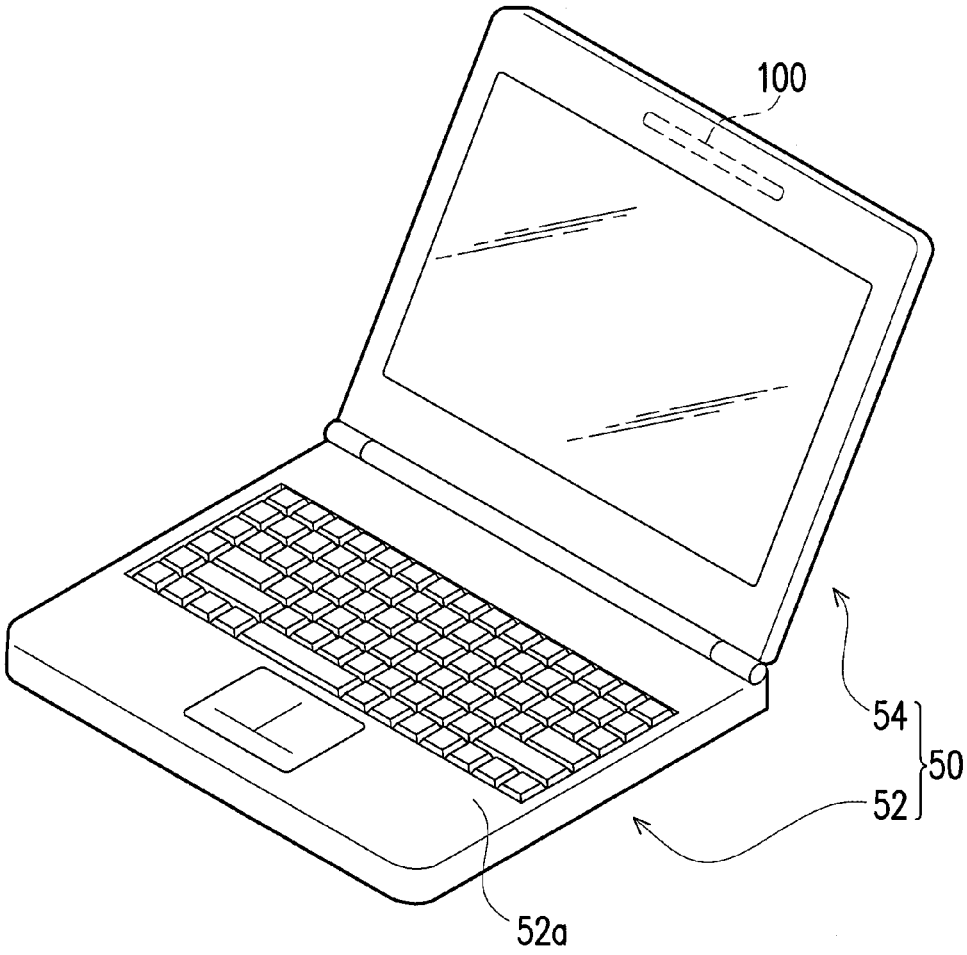
FIG. 2 is a schematic view of an electronic device utilizing the multi-band antenna of FIG. 1.
Figure 3:
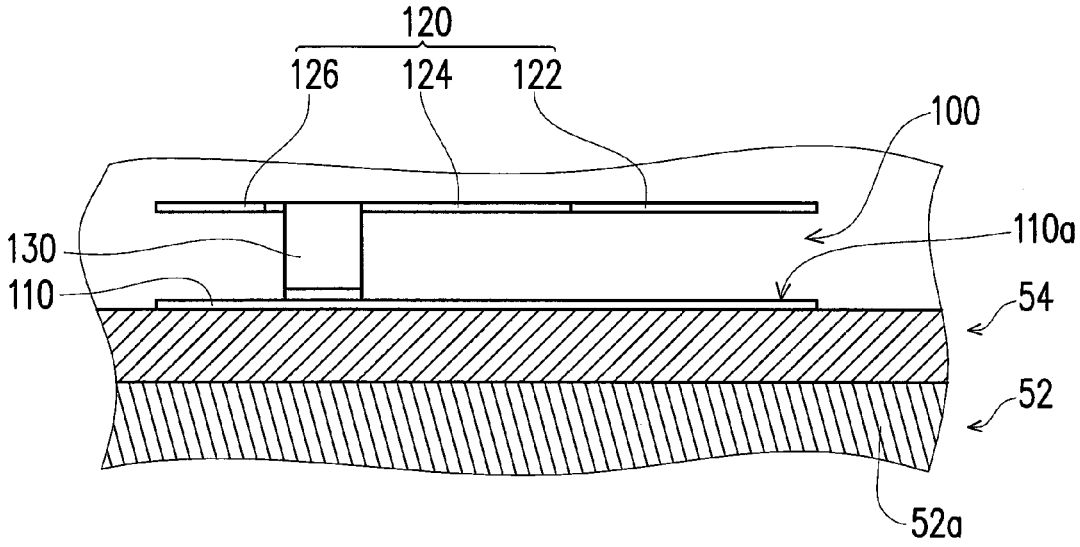
FIG. 3 is a schematic partial view of FIG. 2 in which a second body closed on a first body.

FIG. 2 is a schematic view of an electronic device utilizing the multi-band antenna of FIG. 1. FIG. 3 is a schematic partial view of FIG. 2 in which a second body closed on a first body. Referring to FIGS. 2 and 3 together, the multi-band antenna 100 is suitable for an electronic device 50, the electronic device 50 may be, for example, a notebook computer including a first body 52 and a second body 54, the first body 52 and the second body 54 may respectively be, for example, a host and a display screen of the notebook computer. The second body 54 is pivoted to the first body 52, and the electronic device 50 has a metal shell 52*a*. The metal shell 52*a* is disposed on the first body 52, and the multi-band antenna 100 is disposed on the second body 54. When the second body 54 is closed on the first body 52 as shown in FIG. 3, the ground portion 110 obstructs a path between the metal shell 52*a* and the radiating section (i.e., the first radiating section 122, the second radiating section 124 and the third radiating section 126). In this case, orthographic projections of said radiating sections on the metal shell 52*a* are located within an orthographic projection of the ground portion 110 on the metal shell 52*a*. Accordingly, even though the first radiating section 122, the second radiating section 124 and the third radiating section 126 of the multi-band antenna 100 are adjacent to the metal shell 52*a*, interference to the first radiating section 122, the second radiating section 124 and the third radiating section 126 caused by the metal shell 52*a* may be avoided by the ground portion 110 obstructing the path between the radiating portion 120 and the metal shell 52*a*, so that the multi-band antenna 100 may have a favorable capability for transceiving signal.

Figure 4:
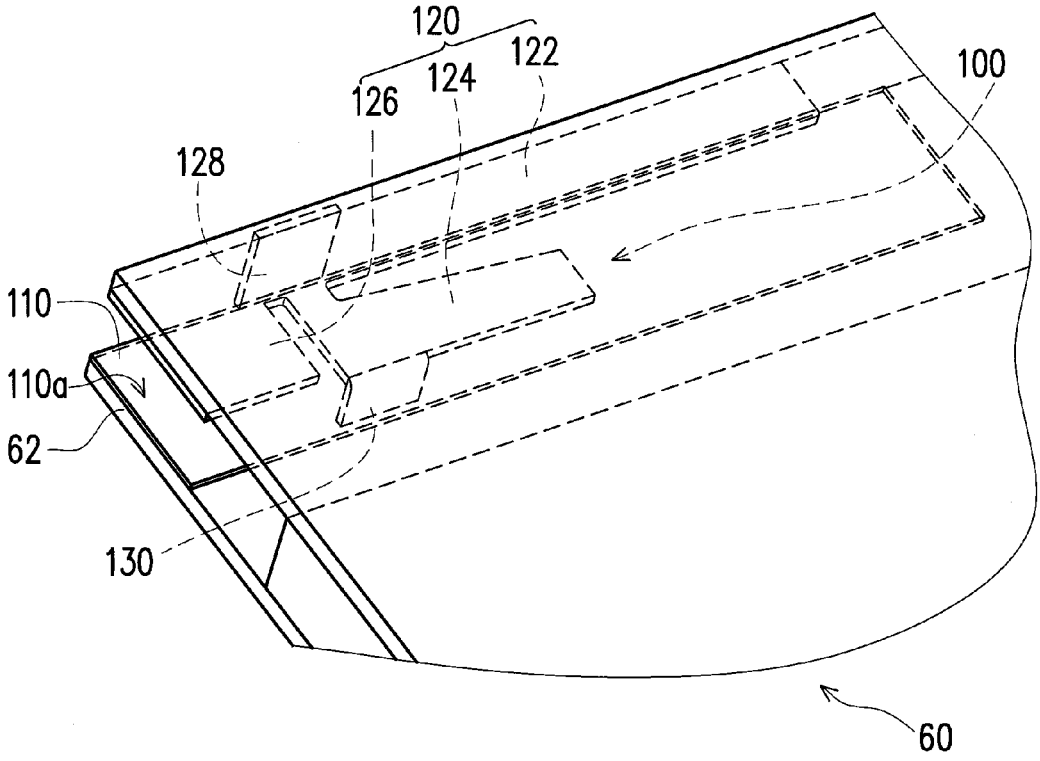
FIG. 4 is a schematic view of another electronic device utilizing the multi-band antenna of FIG. 1.

FIG. 4 is a schematic view of another electronic device utilizing the multi-band antenna of FIG. 1. Referring to FIG. 4, the multi-band antenna 100 is also adapted for another electronic device 60, the electronic device 60 may be, for example, a tablet PC or a smart phone and provided with a metal shell 62. The multi-band antenna 100 is secured at a side of the metal shell 62, and the ground portion 110 obstructs a path between the metal shell 62 and the radiating section (i.e., the first radiating section 122, the second radiating section 124 and the third radiating section 126). In this case, orthographic projections of said radiating sections on the metal shell 62 are located within an orthographic projection of the ground portion 110 on the metal shell 62. Accordingly, even though the first radiating section 122, the second radiating section 124 and the third radiating section 126 of the multi-band antenna 100 are adjacent to the metal shell 62, interference to the first radiating section 122, the second radiating section 124 and the third radiating section 126 caused by the metal shell 62 may be avoided by the ground portion 110 obstructing the path between the radiating portion 120 and the metal shell 62, so that the multi-band antenna 100 may have a favorable capability for transceiving signal.

Referring to FIG. 1, in the present embodiment, extending directions of the first radiating section 122, the second radiating section 124 and the third radiating section 126 are all parallel to the ground plane 110*a* of the ground portion 110. A distance D between the radiating section (i.e., the first radiating section 122, the second radiating section 124 and the third radiating section 126) and the ground plane 110*a* is, for example, greater than 3.5 mm, which may allow the multi-band antenna 100 to have a more preferable performance.

According to the present embodiment, a length of the first radiating section 122 is, for example, 0.25 times to a wavelength of a first resonance frequency band, a length of the second radiating section 124 is, for example, 0.25 times to a wavelength of a second resonance frequency band and a length of the third radiating section 126 is, for example, 0.25 times to a wavelength of a third resonance frequency band. As a result, the first radiating section 122, the second radiating section 124 and the third radiating section 126 are adapted to transceive a signal matching the first resonance frequency band, a signal matching the second resonance frequency band and a signal matching the third resonance frequency band, respectively.

Figure 5:
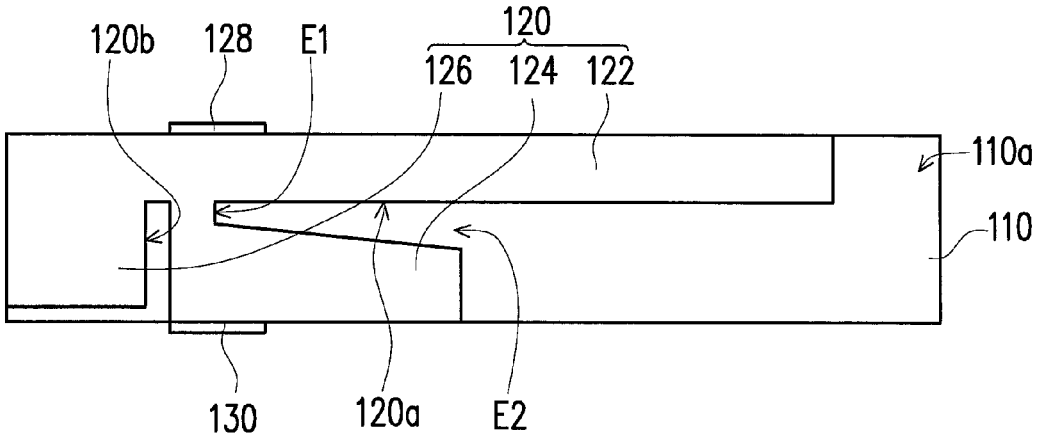
FIG. 5 is a top view of the multi-band antenna of FIG. 1.

FIG. 5 is a top view of the multi-band antenna of FIG. 1. Referring to FIG. 5, in the present embodiment, a first slot 120*a* is provided between the first radiating section 122 and the second radiating section 124, and a second slot 120*b* is provided between the second radiating section 124 and the third radiating section 126. An opening direction of the first slot 120*a* is parallel to an extending direction of the first radiating section 122, and an opening direction of the second slot 120*b* is parallel to an extending direction of the third radiating section 126. In particular, the first slot 120*a* has a closed end E1 and an opening end E2 opposite to one another, and a width of the first slot 120*a* is gradually increased from the closed end E1 to the opening end E2, so as to regulate impedance matching of the multi-band antenna 100 to increase signal transceiving efficiency of the multi-band antenna 100.

Figure 6:
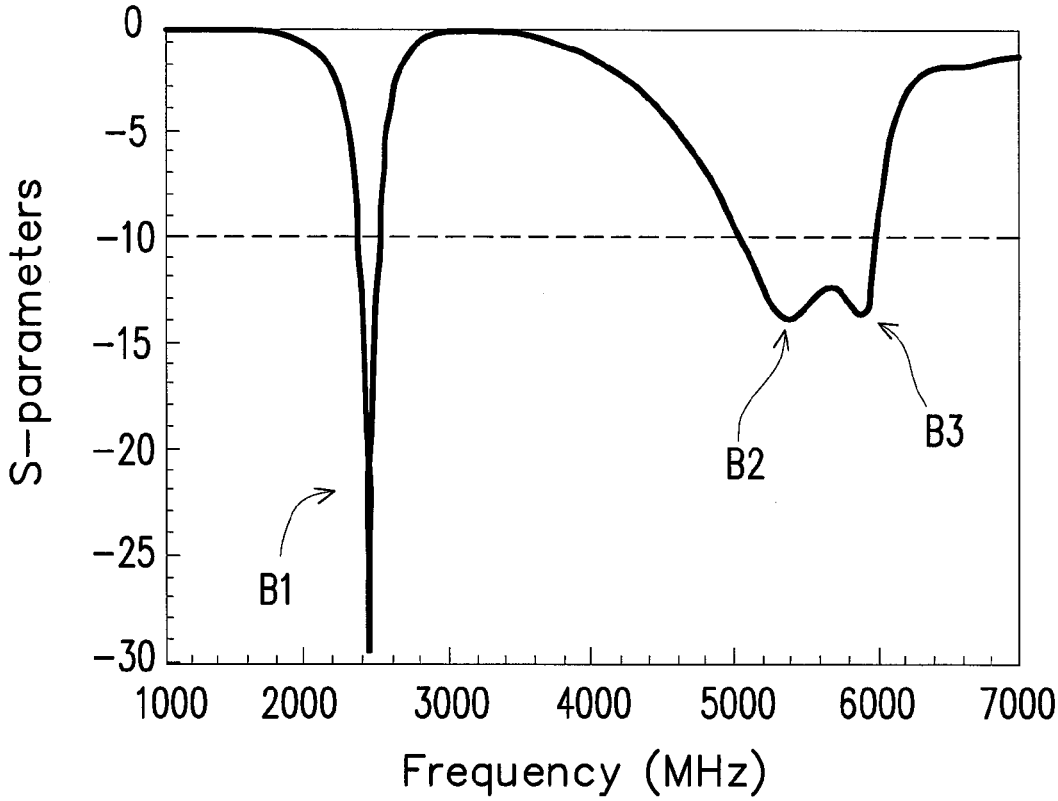
FIG. 6 is a schematic view illustrating characteristics of S-parameters of the multi-band antenna of FIG. 1.

Referring to FIG. 1, in the present embodiment, a length of the first radiating section 122 is relatively longer, whereas lengths of the second radiating section 124 and the third radiating section 126 are relatively shorter. Moreover, the lengths of the second radiating section 124 and the third radiating section 126 are similar to one another, such that the second resonance frequency band corresponding to the second radiating section 124 is also relatively similar to the third resonance frequency band corresponding to the third radiating section 126. FIG. 6 is a schematic view illustrating characteristic of S-parameters of multi-band antenna of FIG. 1. The first resonance frequency band, the second resonance frequency band and the third resonance frequency band are respectively marked as B1, B2 and B3 in FIG. 6. As shown in FIG. 6, since the second resonance frequency band and the third resonance frequency band are relatively similar to one another, an operating frequency band composed by the second resonance frequency band and the third resonance frequency band may be broader, and a frequency range of the operating frequency band is greater than a frequency range of the second resonance frequency band and greater than a frequency range the third resonance frequency band.

Figure 7:
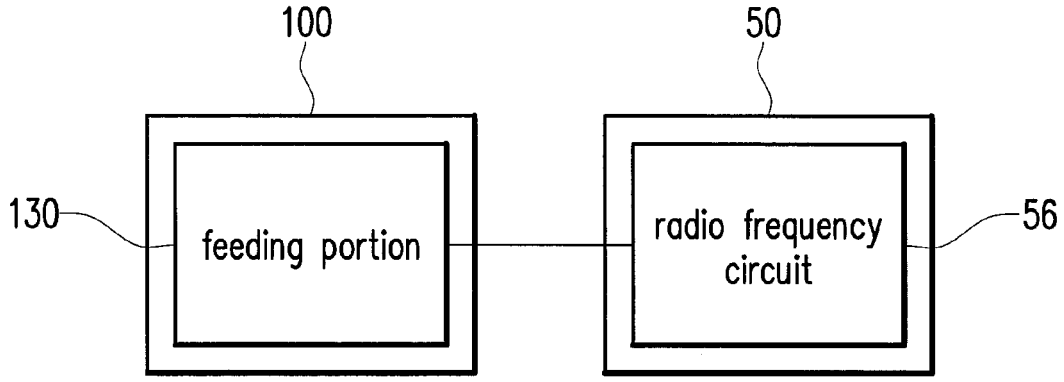
FIG. 7 is a block diagram illustrating a partial component of the electronic device of FIG. 2.

FIG. 7 is a block diagram illustrating a partial component of the electronic device of FIG. 2. Referring to FIG. 7, the electronic device 50 has, for example, a radio frequency circuit 56, and the feeding portion 130 of the multi-band antenna 100 is used for feeding a radio frequency signal of the radio frequency circuit 56. As shown in FIG. 1, the feeding portion 130 is connected to the second radiating section 124 and an extending direction of the feeding portion 130 is, for example, vertical to the ground plane 110*a* of the ground portion 110, so that the feeding portion 130 may extend from the second radiating section 124 to the ground plane 110*a*. In other embodiments, the feeding portion 130 may have other proper extending directions, the invention is not limited thereto.

Figure 8:
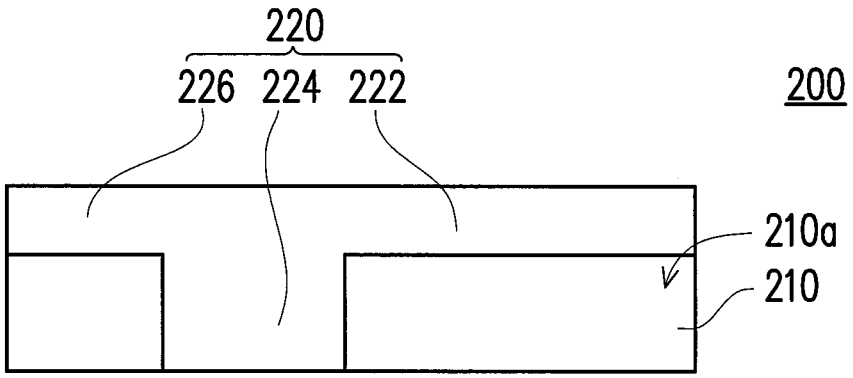
FIG. 8 is a top view of a multi-band antenna according to another embodiment of the invention.

Shapes of the radiating portion and its radiating sections in the multi-band antenna are not particularly limited in the invention. It will be further described with reference to the figures. FIG. 8 is a top view of a multi-band antenna according to another embodiment of the invention. Referring to FIG. 8, in a multi-band antenna 200 according to the present embodiment, a radiating portion 200 includes a first radiating section 222, a second radiating section 224 and a third radiating section 226. Extending directions of the first radiating section 222, the second radiating section 224 and the third radiating section 226 are all parallel to a ground plane 210*a* of a ground portion 210. The difference between the radiating portion 220 of the present embodiment and the radiating portion 120 as shown in the FIG. 5 lies where: Shapes of the first radiating section 222, the second radiating section 224 and the third radiating section 226 are respectively different to shapes of the first radiating section 122, the second radiating section 124 and the third radiating section 126. In addition, the first slot 120*a* and the second slot 120*b* as shown in FIG. 5 are not provided respectively between the first radiating section 222 and the second radiating section 224 and between the second radiating section 224 and the third radiating section 226. In other embodiments, the radiating portion and its radiating sections may have other proper extending directions, the invention is not limited thereto.

Based on above, in the multi-band antenna according the invention, the extending directions of the radiating sections are all parallel to the ground plane, and the ground portion obstructs a path between the metal shell of the electronic device and the radiating sections of the multi-band antenna, so that the orthographic projections of the radiating sections on the metal shell may located within the orthographic projection of the ground portion on the metal shell. Accordingly, even though the radiating sections of the multi-band antenna are adjacent to the metal shell, interference to the radiating sections caused by the metal shell may be avoided by the ground portion obstructing the path between the radiating portion and the metal shell, so that the multi-band antenna may have a favorable capability for transceiving signal.

Although the invention has been described with reference to the above embodiments, it is apparent to one of the ordinary skill in the art that modifications to the described embodiments may be made without departing from the spirit of the invention. Accordingly, the scope of the invention will be defined by the attached claims not by the above detailed descriptions.

What is claimed is:

1. A multi-band antenna, suitable for an electronic device having a metal shell, comprising:

a ground portion having a ground plane;

a radiating portion having at least one radiating section and a short-circuit section, wherein an extending direction of the radiating section is parallel to the ground plane, the short-circuit section is electrically connected between the radiating section and the ground plane, the ground portion is adapted to obstruct a path between the metal shell and the radiating section; and a feeding portion electrically connected to the radiating section, wherein a shortest distance between the short-circuit section and the feeding portion is equal to a width of the ground portion.

2. The multi-band antenna of claim 1, wherein an extending direction of the feeding portion is vertical to the ground plane.

3. The multi-band antenna of claim 1, wherein the electronic device comprises a first body and a second body, the first body is pivoted to the second body, the metal shell is disposed on the first body, the multi-band antenna is disposed on the second body, the ground portion obstructs the path between the metal shell and the radiating section when the second body is closed on the first body.

4. The multi-band antenna of claim 1, wherein the multi-band antenna is secured on a side of the metal shell, and the ground portion obstructs the path between the metal shell and the radiating section.

5. The multi-band antenna of claim 1, wherein an orthogonal projection of the radiating section on the metal shell is located within an orthographic projection of ground portion on the metal shell when the ground portion obstructs the path between the metal shell and the radiating section.

6. The multi-band antenna of claim 1, wherein a distance between the radiating section and the ground plane is greater than 3.5 mm.

7. The multi-band antenna of claim 1, wherein an amount of the at least one radiating section is more than one and the radiating sections comprises a first radiating section, a second radiating section and a third radiating section.

8. The multi-band antenna of claim 7, wherein a length of the first radiating section is 0.25 times to a wavelength of a first resonance frequency band, a length of the second radiating section is 0.25 times to a wavelength of a second resonance frequency band and a length of the third radiating section is 0.25 times to a wavelength of a third resonance frequency band.

9. The multi-band antenna of claim 8, wherein the second resonance frequency band is similar to the third resonance frequency band, an operating frequency band is composed by the second resonance frequency band and the third resonance frequency band, a frequency range of the operating frequency band is greater than a frequency range of the second resonance frequency band and a frequency range of the third resonance frequency band.

10. The multi-band antenna of claim 7, wherein a first slot is provided between the first radiating section and the second radiating section, an opening direction of the slot is parallel to an extending direction of the first radiating section.

11. The multi-band antenna of claim 10, wherein the slot has a closed end and an opening end opposite to one another, a width of the first slot is gradually increased from the closed end to the opening end.

12. The multi-band antenna of claim 8, wherein a slot is provided between the second radiating section and the third radiating section, an opening direction of the second slot is parallel to an extending direction of the third radiating section.

13. The multi-band antenna of claim 1, wherein the electronic device has a radio frequency circuit, the feeding portion is used for feeding a radio frequency signal of the radio frequency circuit.

* * * * *